US010718586B2

(12) United States Patent
Glisovic et al.

(10) Patent No.: US 10,718,586 B2
(45) Date of Patent: Jul. 21, 2020

(54) METAL-METAL-MATRIX COMPOSITE BARRELS

(71) Applicant: CONSULTING GROUP OF JOCASSEE, INC., Pickens, SC (US)

(72) Inventors: Anja Glisovic, Schleswig-Holstein (DE); Steve Franklin Gravely, Pickens, SC (US); Joshua Gravely, Pickens, SC (US)

(73) Assignee: CONSULTING GROUP OF JOCASSEE, INC., Pickens, SC (US)

( * ) Notice: Subject to any disclaimer, the term of this patent is extended or adjusted under 35 U.S.C. 154(b) by 0 days.

(21) Appl. No.: 16/423,871

(22) Filed: May 28, 2019

(65) Prior Publication Data

US 2019/0310044 A1 Oct. 10, 2019

Related U.S. Application Data

(63) Continuation-in-part of application No. 14/579,584, filed on Dec. 22, 2014, now abandoned.

(30) Foreign Application Priority Data

Apr. 25, 2014 (DE) ..... 10 2014 006 081
Sep. 16, 2014 (DE) ..... 10 2014 013 663

(51) Int. Cl.
*F41A 21/02* (2006.01)
*F41A 21/20* (2006.01)
*F41A 21/24* (2006.01)

(52) U.S. Cl.
CPC ..... *F41A 21/02* (2013.01); *F41A 21/20* (2013.01); *F41A 21/24* (2013.01)

(58) Field of Classification Search
CPC ..... F41A 21/00; F41A 21/02; F41A 21/04; F41A 21/022; F41A 21/24
USPC ..... 42/76.01, 76.02, 76.1, 78; 89/14.05, 89/14.1, 14.7, 15, 16
See application file for complete search history.

(56) References Cited

U.S. PATENT DOCUMENTS 621,085 A * 3/1899 Hookham ..... F41A 21/24 89/14.1
4,685,236 A * 8/1987 May ..... F41A 21/02 42/76.02
5,355,765 A * 10/1994 Rogers ..... F41A 13/12 89/14.4
5,856,630 A * 1/1999 Meger ..... F41B 6/006 124/3
7,735,408 B1 * 6/2010 Becker ..... F41F 1/06 102/374
9,618,290 B1 * 4/2017 Redmon ..... F41A 21/20
(Continued)

*Primary Examiner* — Bret Hayes
(74) *Attorney, Agent, or Firm* — Cronin PLLC; Aaron Pickell

(57) ABSTRACT

A weapon barrel has a barrel core composed of iron or nickel alloy and at least one barrel jacket made from a metal-matrix material encasing the barrel core. The jacket and core thereby form a metal-metal-matrix composite barrel. The metal-matrix material may have a specific tensile strength that is greater than or equal to 80 N·m/g, and greater than or equal to the specific tensile strength of the barrels core material. The metal matrix material may include aluminum, titanium, beryllium and magnesium alloys, and composites, in addition to a filler material such as carbon nanotubes, graphite, diamond, carbides, and nitrides.

19 Claims, 5 Drawing Sheets

(56) References Cited

U.S. PATENT DOCUMENTS

| | | | | |
|---|---|---|---|---|
| 2003/0010186 | A1* | 1/2003 | Muirhead | F41A 21/24 89/14.1 |
| 2004/0244257 | A1* | 12/2004 | Degerness | F41A 21/02 42/76.02 |
| 2005/0262997 | A1* | 12/2005 | Brixius | F41A 13/06 89/14.1 |
| 2006/0024490 | A1* | 2/2006 | Werner | B22D 19/14 428/323 |
| 2007/0261599 | A1* | 11/2007 | Schwab | C04B 35/589 106/286.8 |
| 2010/0034686 | A1* | 2/2010 | Peterson | C22C 1/045 419/11 |
| 2014/0076135 | A1* | 3/2014 | Balthaser | F41A 21/44 89/14.1 |

* cited by examiner

METAL-METAL-MATRIX COMPOSITE BARRELS

CLAIM OF PRIORITY

This application claims priority to pending U.S. patent application Ser. No. 14/579,584 which in turn claims priority to German patent application no. 102014013663.9 (filed on Sep. 16, 2014) and German patent application no. 102014006081 (filed on Apr. 25, 2014).

TECHNICAL FIELD

The invention is directed to the construction of weapon barrels from a steel core and at least one metal-matrix material sleeve, forming a composite metal-metal-matrix barrel which are applicable in rifles, shotguns, cannons, and mortars. Due to the properties of the metal-matrix materials (e.g. higher specific strength, higher specific heat capacity and lower density), the composite barrels can exhibit a higher rate of fire, reduced weight, improved accuracy, or a combination of any of these properties. Disclosed are various exemplary embodiments of such barrels with improved performance, properties of the metal-matrix materials necessary to allow these improvements as well as methods to produce the same.

BACKGROUND OF THE INVENTION

It has long been understood that weapon barrels have to withstand the pressure of the discharging ammunition and provide enough stiffness for sufficient accuracy. This need can be met simply by a high wall thickness of the barrel. With increased wall thickness, the maximum pressure load the barrel can bear is improved as well as its stiffness by the larger diameter and subsequent increased second moment of area. These advantages are offset by the barrel weight, which should be as low as possible to ensure swift weapon operation, especially in manually supported weapons like rifles and shotguns. Furthermore the barrel should allow repeated accuracy at consecutive shots, e.g. as found in automatic weapons. This is hindered by the heat up of the barrel which leads to thermal expansion and stress in the barrel and results in a loss of accuracy. Accordingly an ideal weapon barrel is stiff and light at the same time and heats up slowly and/or has great cooling efficiency by an advantageous surface-to-volume or more accurately an improved surface-to-heat capacity-ratio.

SUMMARY

Metal-Matrix Composite Barrels are barrels comprised of an iron or nickel alloy core with at least one sleeve made from a metal-matrix material, applicable in rifles, shotguns, cannons, and mortars. Due to the properties of the metal-matrix materials (e.g. higher specific strength, higher specific heat capacity and lower density), the composite barrels can exhibit a higher rate of fire, reduced weight, improved accuracy, or a combination of any of these properties. Furthermore, the sleeve contributes to the pressure resistance of the barrel if the metal-matrix sleeve is properly fitted to the barrel core.

DETAILED DESCRIPTION

Figure 1:
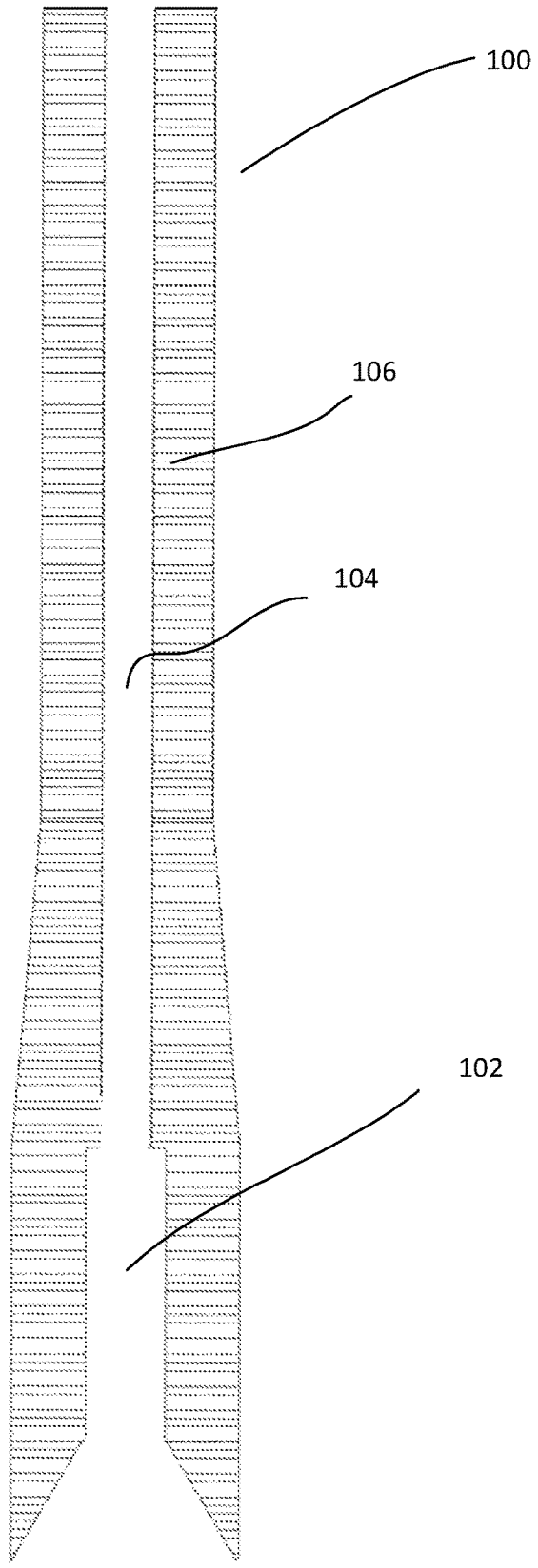
FIG. 1 (Prior Art)
FIG. 1 is a schematic, longitudinal section view of a conventional rifle barrel.

Currently, state of the art barrels are made from homogeneous metal alloys, especially steels (iron alloys) and nickel alloys. As shown in FIG. 1A, a conventional barrel 100 has a cylindrical bore 104 and a breach 102, from which a projectile is fired through the bore 104. When operated, the barrel 100 is subject to the pressure associated with the load that is used to propel the bullet, but should remain stiff and straight enough to provide sufficient accuracy. In a conventional design, stiffness and load tolerance may be achieved simply by providing a barrel with a high wall thickness of the barrel 100. Increased wall thickness may generally result in the maximum pressure load the barrel can withstand, increased barrel its stiffness (by virtue of the larger diameter), and an increased second moment of area. These advantages are offset, however, by an increase in barrel weight, which may interfere with swift operation of the weapon in which the barrel 100 operates.

To enhance weapon performance, it may be advantageous to increase the diameter of the barrel 100 while minimally increasing the weight of the barrel 100. In some cases, the barrel weight may be decreased while the diameter of the barrel 100 is increased. A simultaneous increase in diameter and decrease in weight may be achieved by using composite barrels having layers of fiber composite wrapped around a barrel core. Examples of such barrels are rifle barrels with extremely thin wall thicknesses and fiber composite wraps as described in patent CA2284893C and WO2011146144 A2. Usually carbon fiber composites are used for this purpose with a resin matrix based on epoxy resins.

Carbon fiber composites normally have a specific tensile strength higher than that of steels and nickel alloys. Therefore, a carbon fiber wrapped barrel can be lighter than a standard barrel made solely from a metal alloy. However, a disadvantage of such systems may be reduced thermal stability that results in a restriction as to the weapon's use—sometimes restricting use in semi or fully automatic weapons to a few shots. To that end, barrels having carbon fiber jacket configurations may only be suitable for deployment in systems in which the temperature of the barrel doesn't rise above 100° C. for extended periods of times, and especially not above 200° C. Above these temperatures the organic resin matrix of a carbon fiber material may degrade permanently. Carbon fiber composite wraps may also act as insulators due to their low thermal conductivity. The insulating characteristic of the carbon fiber material may result in such barrels having a limited ability to dissipate heat, which may adversely affect the precision of the weapon as a result of thermal barrel creep.

Other barrel types made from different materials are found in smooth bore cannons, such as those deployed in Abrams and Leopard II battle tanks. These types of barrels may actually have an insulating outer layer that facilitates the management of heat transfer but does not enhance the barrels' other mechanical properties, such as integrity and stiffness. This characteristic distinguishes these barrels from the previously described wrapped fiber composite barrels in which the fiber wrap contributes to the barrels' mechanical properties.

An alternative form of a multilayered composite barrel with improved stiffness is given in patent publication no. US 2011/0113667A1. The barrel's stiffness is provided with an outer metal sleeve. The void between the barrel and the sleeve is sealed with a light, hardening filler material. Unfortunately, in this type of system, the filler material may have some properties that negatively affect performance. For example, the filler may be a poor thermal conductor, which would result in a barrel that may experience hot spots and thermal creep under operating conditions. Such properties may restrict such a barrel system from being used in semi and fully automatic weapons since the sustainable rate of fire would be reduced to prevent overheating and thermal creep. Additionally, overheating and thermal creep can cause the sleeve to separate from the filler and barrel core due to the sleeve material having a higher thermal expansion coefficient in comparison to both the filler and barrel core. Such misaligned properties may result in a loss of mechanical integrity and accuracy.

The present disclosure describes 'Metal-Metal-Matrix Composite Barrels' that overcome the aforementioned shortcomings of the state of the art by using innovative metal-matrix materials which combine a linear thermal expansion coefficient similar to those found in iron and nickel alloys with a specific tensile strength greater than that commonly found in barrel steel and nickel alloys, such as 316, 4140 and 4150 steels.

The metal-matrix materials used are based on light metals; accordingly, their density is significantly lower than the density of iron and nickel alloys. The consequence of this combination of material properties is that the greater specific tensile strength allows weight reduction while the lower density results in a larger barrel diameter. The increased diameter may lead to increased stiffness of the barrel, which in turn may yield improved accuracy. Examples of such barrels are shown in FIGS. 2A and 2B.

Figure 2A:
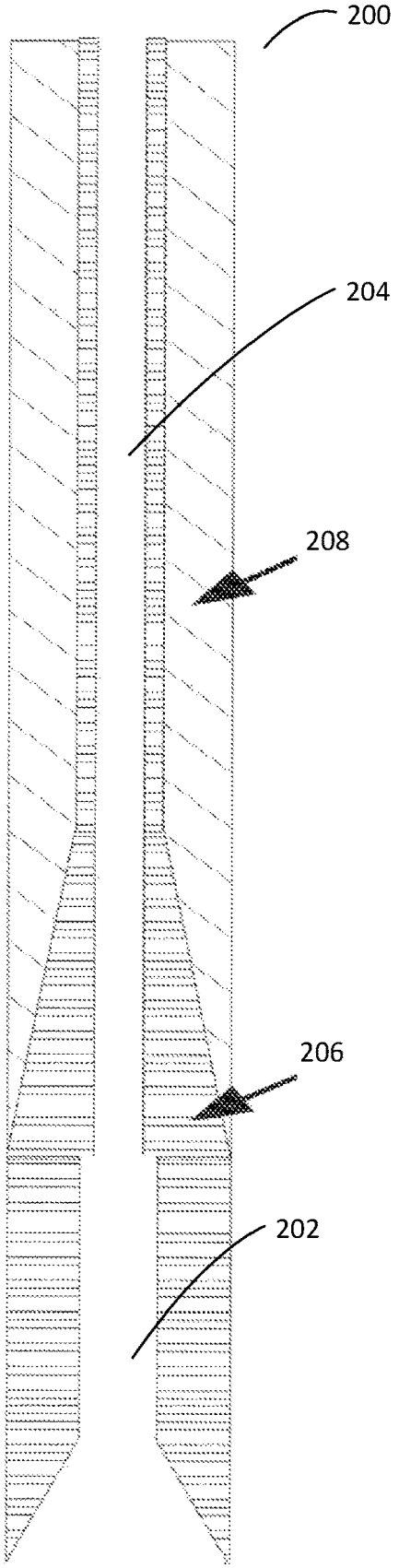
FIG. 2A is a schematic, longitudinal section view of a metal-metal-matrix composite barrel, in which the metal-matrix jacket only extends over the barrel and not the breach.
Figure 2B:
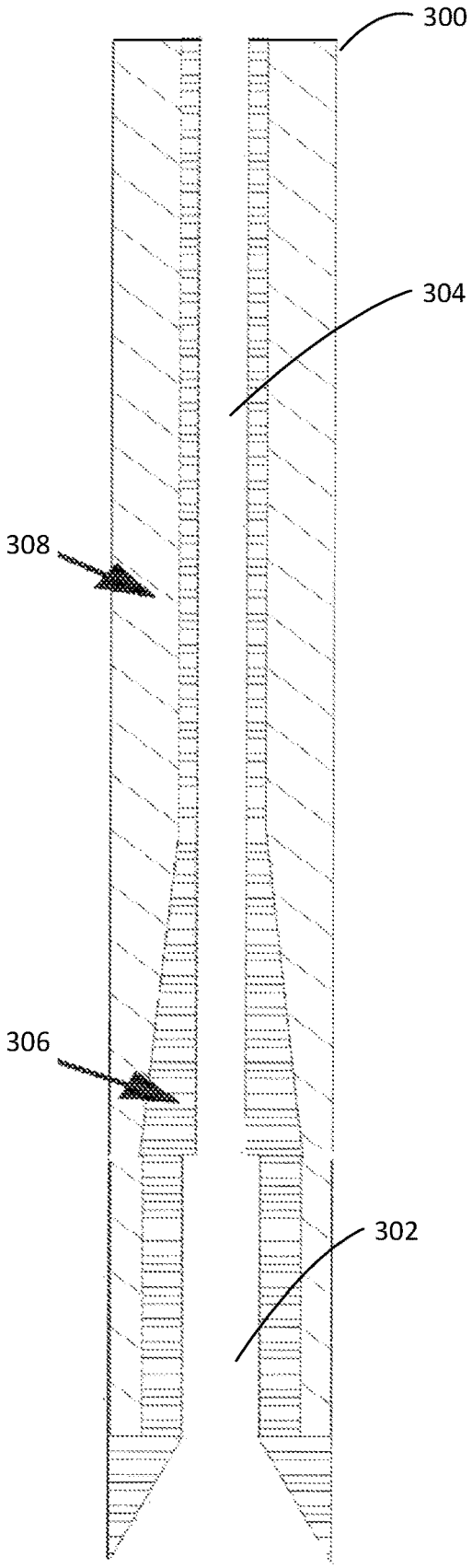
FIG. 2B is a schematic, longitudinal section view of a metal-metal-matrix composite barrel, in which the metal-matrix jacket extends over the whole barrel and the breach.

In FIG. 2A, a representative barrel 200 includes a barrel core 206 having a bore 204 and breach 202. The portion of the barrel core 206 that extends beyond the breach 202 is encased by a metal-matrix barrel jacket 208. Similarly, in FIG. 2B, a representative barrel 300 includes a barrel core 306 having a bore 304 and breach 302. In FIG. 2B, however, a metal-matrix barrel jacket 308 surrounds the full length of the barrel core 306, including the portion that includes the breach 302.

The relevant metal-matrix materials may be selected to have a higher thermal conductivity and specific heat capacity than the barrel core, thereby allowing improved heat management. Due to the higher thermal conductivity, the formation of hot spots in the barrels is hindered, the barrel will heat up more evenly, and the whole surface of the barrel can contribute more efficiently to cooling. The increased heat capacity, in turn, means that a barrel featuring a metal-matrix material will heat up much more slowly than a conventional barrel under similar operating conditions. This allows higher rates of fire or a longer time of continuous fire at a standard fire rate until the barrel overheats.

It follows that a metal-metal-matrix composite barrel can have improved (reduced) weight, (increased) accuracy and stiffness, and an increased rate of sustainable fire. Although it is desirable to have all these characteristics improved, it can be advantageous for special applications to improve only one or two of the above mentioned properties significantly while sacrificing other properties. For example, it is possible to forgo weight savings when highest precision is desired by bringing the wall thickness of the barrel to the absolute maximum, thereby gaining stiffness and heat capacity. Additionally, the metal-matrix materials discussed herein allow for continuous use of a barrel above 100° C., and in some embodiments, above 200° C. These advantages are due to the composite barrel comprising materials with a metal-matrix and not organic fiber composites whose resin matrix would invariably degrade at these temperatures. Accordingly, the barrel configurations described herein may be better suited for use as barrels in semi and fully automatic weapons, and in barrels that otherwise carry high thermal loads that may result from (for example) high rates of fire or the use of certain types of ammunition.

Many reinforced light metals, including without limitation aluminum and magnesium alloys, are suitable for use as metal-matrix material in the presented metal-metal-matrix composite barrels. In many embodiments, it is preferable that representative barrels exhibit one or more of the following characteristics (with regard to the selected metal-matrix material): (1) metal-matrix materials having a specific tensile strength that is equal or greater than that of iron alloys (steel) and nickel alloys typically used in weapon barrels, including metal-matrix materials with a specific tensile strength of at least 80 N·m/g; (2) metal-matrix materials having a specific tensile strength of at least 150 N·m/g; (3) metal-matrix materials having a specific tensile strength that is greater than the specific tensile strength of the barrel's core material; (4) metal-matrix materials having a density of less than 7 g/cm$^3$; metal-matrix materials having a density of less than 4 g/cm$^3$; (5) metal-matrix materials comprising light metals, such as aluminum, titanium or magnesium as matrix material and thermally highly conductive fillers like carbon nanotubes, boron nitride, diamond or silicon carbide particles as fillers; (6) metal-matrix materials having a linear thermal expansion coefficient of between 0 and 30 ppm/K; (7) metal-matrix materials having a linear thermal expansion coefficient of between 10 and 15 ppm/K; (8) metal-matrix materials having thermal conductivity that is equivalent to or greater than the material that forms the barrel core; (9) metal-matrix materials having thermal conductivity between 5 to 400 W/m·K; (10) metal-matrix materials having thermal conductivity between 100 and 400 W/m·K; (11) metal-matrix materials heat capacities that are equivalent to or greater than the as iron and nickel alloys which form the barrel core; (12) metal-matrix materials specific having a heat capacity of greater than 0.45 J/g·K; and (13) metal-matrix materials specific having a heat capacity of between 0.7 and 0.9 J/g·K.

Especially suitable metal-matrix materials are those containing highly thermally conductive fillers like carbon nanotubes, boron nitride, diamond, or silicon carbide in an aluminum matrix. In some embodiments, the degree of filler should be such that the thermal expansion coefficient is between 10 to 15 ppm/K and thermal conductivity higher than that of the barrel core, e.g., from 80 to 200 W/m·K. An example of such metal-matrix materials is the aluminum diamond composite described in the US patent 'Aluminum Composite for Gun Barrels' U.S. Pat. No. 6,482,248B1 by S. R. Holloway or the silicon carbide reinforced aluminum alloys produced by the Materion Cooperation (Mayfield Heights, Ohio, USA) under the brand name SupremEX, especially SupremEX AMC640XA. The properties of this material are given in Table 1 at the end of the patent description together with calculations for an AR-15 type barrel.

The foregoing material (SupremeEX AMC640XA) is understood to be a high quality aluminum alloy that is reinforced with 40 volume percent ultrafine silicon carbide particles. As referenced herein, ultrafine silicon-carbide particles are silicon-carbide particles ranging from 2-3 microns in size. The material is isotropic in nature, and is fabricated using a special powder metallurgy route using a proprietary high-energy mixing process which ensures excellent particle distribution and enhances mechanical properties. The utilized powder metallurgy and mechanical alloying techniques combine an aluminum alloy matrix with ultrafine silicon carbide particles. During fabrication, process conditions are controlled to produce an even distribution of these particles while maintaining the purity of the matrix alloy.

The improvements described herein may be realized in a composite barrel featuring a barrel core made from a steel or nickel alloy, like 316, 4140 or 4150 steel. The barrel core's lowest wall thickness may be the minimum thickness necessary to rifle the barrel and still guarantee sufficient wear resistance for commercial use. In practice, however, the barrel core thickness will depend on the caliber of the weapon and a desired safety factor, e.g. for the tensile strength. In some embodiments, the maximum diameter of the barrel core is not larger than the diameter found in heavy barrel profiles. In such embodiments, the barrel core is again sheathed with the barrel jacket made from metal-matrix material with the aforementioned properties.

In some embodiments, the metal-matrix material in this application has an isotropic thermal expansion coefficient, due to the particulate nature of its filler. The thermal expansion coefficient may be similar to that of the barrel core, as this allows thermal shrink fitting bonding while preventing separation of the two parts under thermal load.

Powder metallurgic production of the metal-matrix material may also allow formation of the jacket directly around the steel core by surrounding the core with the metal-matrix material powder and consolidating the powder to form the jacket by hot isotactic pressing (HIP). Although the aforementioned process creates an effective joint, it is also possible to create the composite barrel by using semi-finished metal-matrix material parts. Such alternative processes may involve forming the jacket around the core by means of flow forming, metal spinning, press fitting, forging, explosive welding or thermal shrink fitting. Other bonding methods to achieve a force bearing joint between the core and jacket include hammer forging and direct extrusion of the jacket around the barrel core or welding.

In a preferred embodiment, the thermal expansion coefficients of core and jacket are identical or differ less than 20%. Such similar thermal expansion coefficients of core and jacket prevents bending under thermal load and reduces the possibility for thermally induced mechanical strain in the barrel. By annealing and quenching the barrel, it is also possible to determine a temperature of minimal strain in the composite barrel different from room temperature. At this preselected temperature, the barrel will be most accurate, and it is feasible to create a composite barrel, which improves in accuracy during heating, up to the temperature of minimal strain. With properly set temperatures of minimal strain at the upper end of the composite barrel's standard operation temperature it is possible to create barrels, which virtually don't show "barrel heat creep" (loss of accuracy due to thermal barrel expansion). This is also possible if more than one jacket is used.

If the thermal expansion coefficients of core and jacket differ by less than 20%, the core and jacket can be bonded directly, e.g. by shrink fitting or direct extrusion or the methods. For example, the metal-matrix material can be joined to the core as an isotropic powder by hot isotactic pressing (HIP) or from semi-finished products by pressure fitting, thermal shrinking, metal spinning, flow forming, forging or explosive welding.

If the difference between the thermal expansion coefficients of the core and jacket are higher, a second (inner) jacket may be inserted between the barrel core and the outer jacket. See FIGS. 5A-6C. In such embodiments, a second jacket 610A, 610B, 710A, 710B, and 710C may be placed between the core (606A, 606B, 706A, 706B, and 706C, respectively) and the outer jacket (608A, 608B, 706A, 708B, and 708C, respectively). The second jacket may be installed using any of the foregoing methods, or by wrapping the core with a thin foil to form the second jacket.

Figures 6A, 6B, 6C:
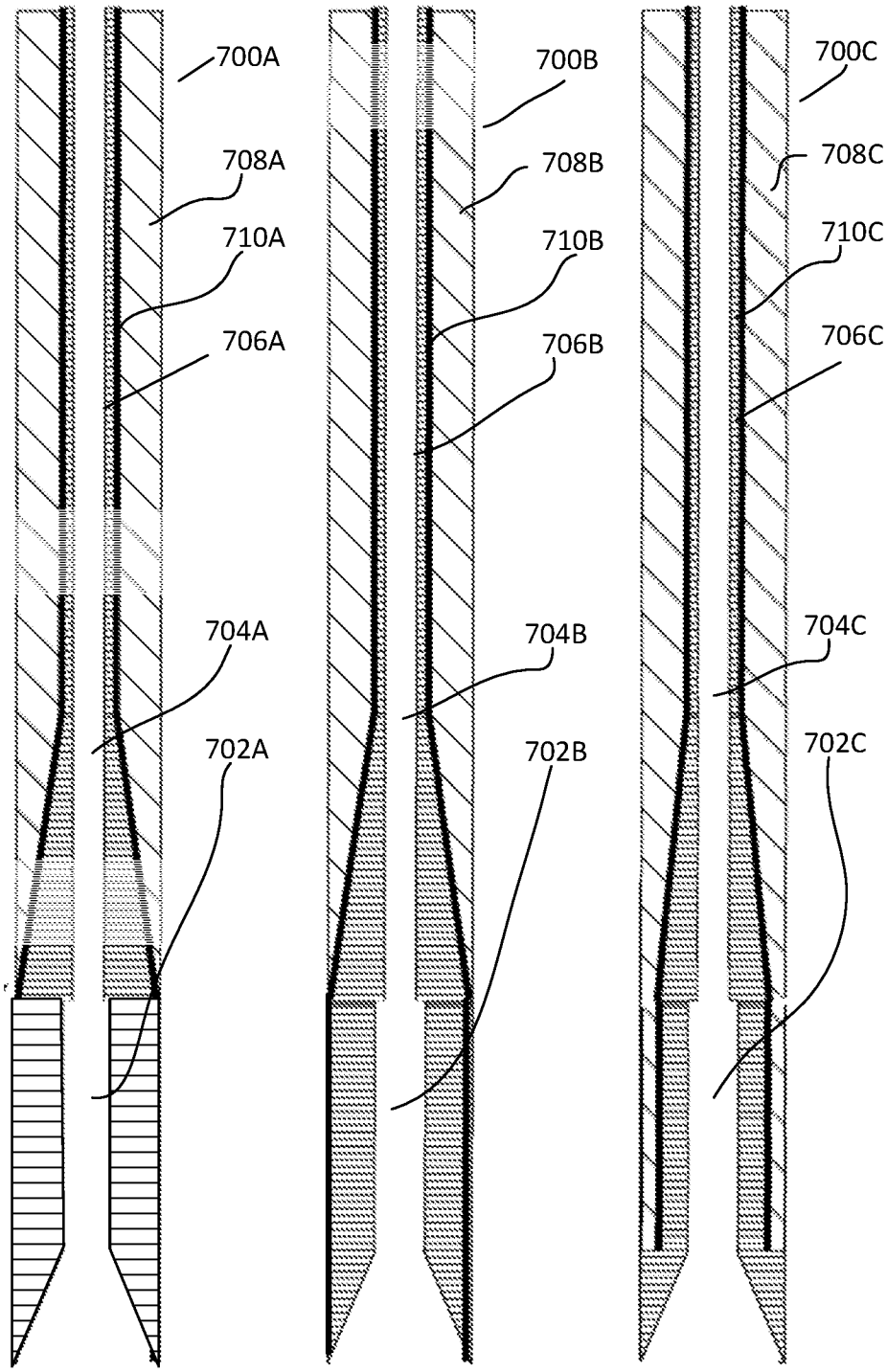
FIG. 6A is a schematic, longitudinal section view of a metal-metal-matrix composite barrel, in which the two metal-matrix jackets only extend over the barrel and not the breach.
FIG. 6B is a schematic, longitudinal section view of a metal-metal-matrix composite barrel, in which the inner metal-matrix jacket extends over the barrel and the breach while the outer jacket only extends over the barrel and not the breach.
FIG. 6C is a schematic, longitudinal section view of a variant metal-metal-matrix composite barrel, in which both metal-matrix jackets extend partly over barrel and breach.

The thermal expansion coefficient of the second, inner jacket may be greater than that of the outer metal-matrix jacket and may have a relatively thin wall thickness. As such, expansion of the inner jacket during heating will be lessened by the outer jacket, thereby facilitating a permanent force fit between the first jacket, second jacket, and barrel core. FIG. 6A demonstrates that the inner jacket 710A may cover the portion of the barrel core 706A that extends beyond the breach in an embodiment in which the outer jacket 708A does not surround the breach 702A. FIG. 6B demonstrates that the inner jacket 710B may alternatively cover the portion of the barrel core 706B that extends beyond the breach 702B and the breach 702B in an embodiment in which the outer jacket 708B does not surround the breach 702B. FIG. 6C demonstrates that the inner jacket 710C may alternatively cover the portion of the barrel core 706C that extends beyond the breach 702C and the breach 702C in an embodiment in which the outer jacket 708C does surround the breach 702C. In each such embodiment, the outer jacket may be joined to the barrel and second, inner jacket using the methods described above.

With respect to barrels that include an outer jacket and a second, inner jacket, the barrel core may prevent shrinkage of the inner jacket during cooling, thereby realizing a force bearing joint between the core and inner jacket throughout the operating temperature range of the barrel. In this embodiment the wall thickness of the barrel core and outer jacket are selected to be thick enough to withstand the pressure of the thermal expansion and shrink that occurs during operation.

In both applications (with or without inner jacket), the joints between the jackets (resulting from, for example, an interference fit) provide sufficient force fit in the temperature range between −40° C. and 150° C., or even from −70° C. to 350° C. Additionally, the barrel core's wall thickness is selected to withstand the forces occurring within this temperature range. In some embodiments, the jacket or jackets extend over the full length of the barrel, as shown in FIGS. 2A, 6A, and 6B. In other embodiments, the metal-matrix jackets extend over the whole barrel and the barrel breach (as shown in FIGS. 2B and 6C to facilitate greater weight savings. In practice, it may also be possible to modify the breach and beginning of the barrel with slight undercuts, cutouts, and notches. These changes further stabilize the metal-matrix jacket and promote its alignment during manufacture when corresponding structures are present in the metal-matrix jacket.

Although the focus of this disclosure is to produce original barrels, the disclosed systems and methods may also be implemented by retrofitting existing barrels. Such retrofitting may be accomplished by installing a sleeve with a metal-matrix jacket around an existing barrel. For this process, a steel barrel, which forms the new barrel core, may be milled down evenly to provide a smooth surface. The metal-matrix jacket then can be attached by e.g. by heating and then cooling a jacket to provide a shrink-fit. In other embodiments, the metal-matrix jacket can be produced from two or more sections placed around the barrel core. The two or more sections may then be welded, bolted, or otherwise fastened together to stiffen and support the barrel core.

If the materials and jacket diameters are properly chosen and assembled, it is possible to increase the stiffness and the heat capacity of the composite barrel by a factor of up to 12. More typical improvements of these properties may range from between 1.5 and 7, and weight may be decreased or only slightly increased. In such instances, weight increase will be less than 25%. The exact improvements and values, however, depend on the chosen wall thicknesses of both barrel core and jacket, the intended use of the metal-metal-matrix barrel, the caliber of the weapon and the properties of the barrel to which they are compared. For example, in AR-15 type barrels, the described barrel system can increase the accuracy by a factor of two while also increasing the sustainable rate of fire rate by a factor of two. A detailed example for an AR-15 is given below.

It should be noted that the time of sustainable fire can be increased when the fire rate is not totally exploited and vice versa. For example, if the fire rate can be increased by a factor of 4 but the actual rate of fire is only increased by a factor of 2 then this fire rate can be sustained twice as long until the critical temperature is reached at which the barrel fails, since the heat energy necessary to make the barrel fail is proportional to the rate of fire and the time of fire and in general higher in the composite barrel. Accordingly, either rate of fire, time of fire, or both can be increased. Also both parameters depend on the mass and the surface-to-volume ratio of the barrel Therefore it is also possible to massively reduce the weight if rate of fire and time of fire stay the same.

The increased diameter of the composite barrel and the higher heat capacity of the metal-matrix materials result in a decrease of the surface-to-volume ratio and ratio of heat capacity to barrel surface area. These factors effectively decrease the capacity of a composite barrel to cool down at the same rate as a conventional steel barrel. This can be counteracted by surface patterning the barrel, e.g. fluting and structuring.

Exemplary profiles are shown and described with regard to FIGS. 3B, 3C, 4A-4C, and 5A and 5B. These surface structures increase the barrel surface area by the same or greater amount by which the surface-to-volume ratio and surface-to-heat-capacity ratio have been decreased. An example of surface structure by six flutes is given in FIGS. 4A and 5B. In some embodiments, the surface area enhancing features may be increase by a factor of 1.5 to 4 (as compared to a comparable round barrel).

Figure 3A:
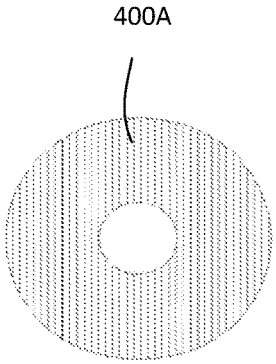
FIG. 3A (Prior Art)
FIG. 3A is a schematic view of a cross-section of a conventional barrel from steel or nickel alloys, without coatings.
Figure 3B:
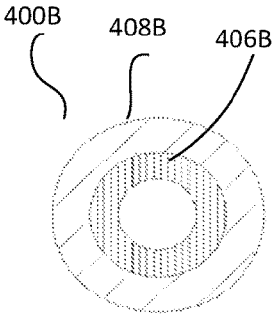
FIG. 3B is a schematic view of a cross-section of a metal-metal-matrix composite barrel in an application of lowest weight, wherein the diameter is smaller than that of the conventional barrel and, accordingly, the area moment of inertia and the stiffness would be lower.
Figure 3C:
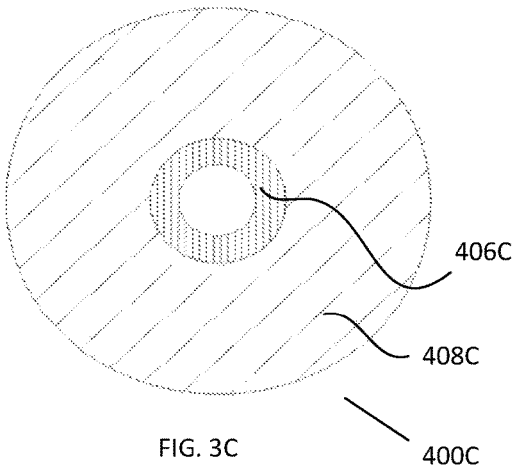
FIG. 3C is a schematic view of a cross-section of a metal-metal-matrix composite barrel with a larger diameter that is configured to provide slower heat up and increased stiffness and accuracy.
Figure 4A:
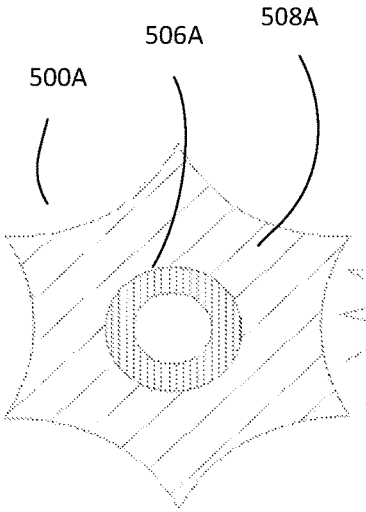
FIG. 4A is a schematic view of a cross-section of a metal-metal-matrix composite barrel with six flutings for increased surface area and improve cooling efficiency.
Figure 4B:
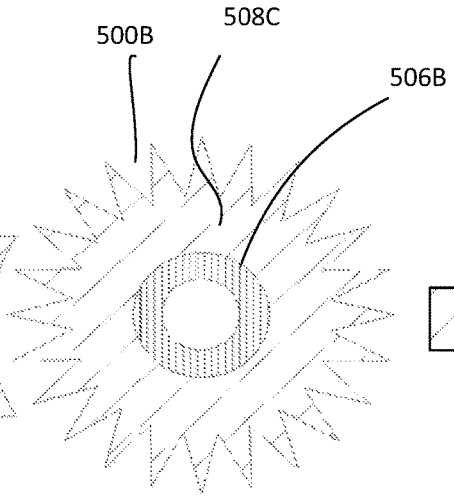
FIG. 4B is a schematic view of a cross-section of a metal-metal-matrix composite barrel with triangular cutouts with a side ratio of 1:3 to 1:4 for increased surface area and improve cooling efficiency.
Figure 4C:
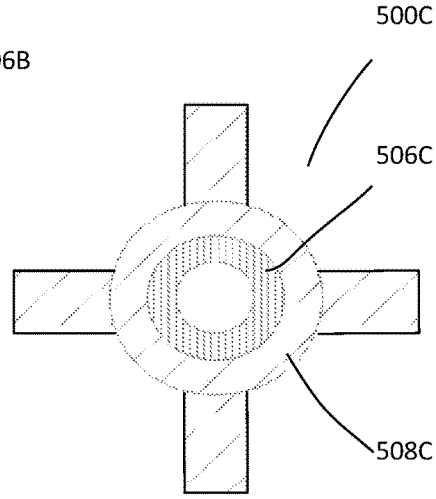
FIG. 4C is a schematic view of a cross-section of a metal-metal-matrix composite barrel with minimal metal-metal-matrix jacket, delivering sufficient pressure resistance and four cooling fins, wherein the cooling fins provide increased surface area for more cooling efficiency and increased stiffness.
Figure 5B:
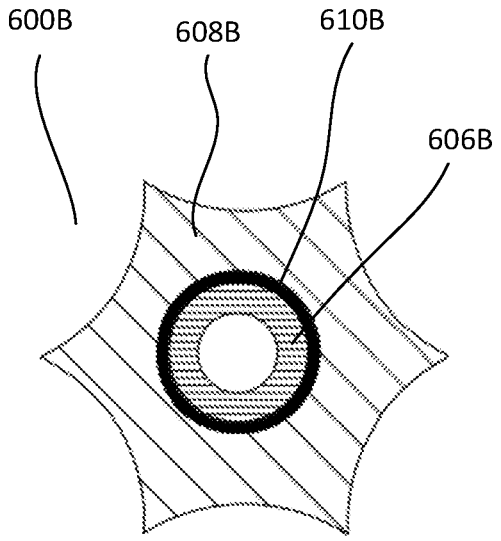
FIG. 5B is a schematic view of a cross-section of a metal-metal-matrix composite barrel with six flutings for increased surface area and two jackets, wherein the inner jacket has a higher linear thermal expansion coefficient than the that of the core and outer jacket.
Figure 5A:
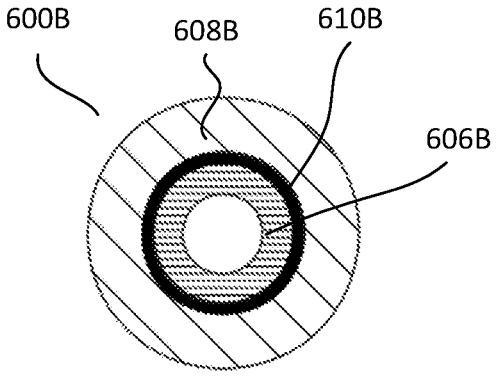
FIG. 5A is a schematic view of a cross-section of a metal-metal-matrix composite barrel with two jackets, wherein the inner jacket has a higher linear thermal expansion coefficient than the that of the core and outer jacket.

In some embodiments, a triangular surface structure or cooling fin design with a triangle's base length of one and the triangle's long edge of length four is provided. An example of a triangular surface structure is shown in FIG. 4B. In these applications only the ratios of the surface patterns are relevant, not the absolute values which make micro- or nano-structures the preferred technique. Due to the lower density of the metal-matrix materials and the greatly increased diameters of the composite barrels, it is even possible to achieve better surface-to-volume ratios in the composite barrel than normally found in conventional barrels. Therefore it is possible to achieve the same or better cooling and combine slower heat up with faster cool down in relation to conventional barrels depending on the chosen embodiment. Extent and depth of the surface patterning depend on the intended characteristics of the composite barrel and can be chosen accordingly. In the extreme, the jacket can consist of a small jacket ring surrounding the barrel core with the stiffness provided by cooling fins. An example of a such an embodiment is shown in FIG. 3C. While the cooling fins are shown as being rectangular, the fins may alternatively be structured or branched, e.g. 'T'- or 'Y'-shaped.

In a further variation of the embodiments described herein, the barrels can be conically and decrease in diameter towards the muzzle to allow further weight reductions. In such instances, either or both of the barrel core and jacket can be tapered. Furthermore, the profiles of both jacket and core can change along the barrel long axis, e.g. by different diameters. This change can help reduce higher harmonics in the barrel and allow barrel whip and vibrations to calm faster, meaning better accuracy and faster consecutive shots with the same precision. Again, these profile changes can occur independently or dependently within a barrel core and barrel jacket as long as the profiling doesn't interfere with the quality of the two parts connected. The realization of these variations will depend again on the intended use and the difficulty of manufacturing but are technically viable.

The so-produced barrels are especially useful for applications in semi and fully automatic weapons, such as rifles and cannons. In bolt actions rifle and shot guns, they have the advantage of providing higher accuracy. Moreover, in thermally, highly strained single fire weapons, such as mortars, these barrels allow higher sustained rates of fire and longer barrel life as well. Since the potential uses are extensive, they cannot be detailed in this document for every case—only their general design and properties. To clarify these possibilities, an example is given on the basis of an AR-15 platform in the next section.

Example AR-15 Barrel, Caliber 5.56 Nato

The examples given here are for metal-metal-matrix composite barrels based on the AR-15 rifle system, caliber 5.56 Nato. An example of the metal-matrix materials are the SupremeEX AMC 640XA properties given in Table 1 together with the 4140 steel properties, the most widely used steel for AR-15 type barrels. The given thicknesses of the barrel core in Table 2 are sufficient to provide pressure resistance alone while the pressure resistance added by the metal-matrix jacket provides a safety factor. Depending on the thickness of the metal-matrix jacket, different properties of the barrel can be achieved. It is possible to save 35% of the weight if the stiffness of the barrel is only preserved, not improved. Alternatively, it is also possible to improve the accuracy of the composite barrel by a factor of 2.3 in comparison to heavy profile barrel profiles while having a weight savings of 18% (see Table 2).

TABLE 1

Comparison of material properties of 4140 barrel steel with the metal matrix material SupremeEX AMX640XA and the potential weight saving. The specific tensile strength of barrel steels is normally in the range of 800 and 850 MPa and their specific tensile strength between 100 and 110 MPa $cm^3/g$ which theoretically allows weight savings in the range of 21 to 57%.

| Material | Tensile Strength [MPa] | Elastic Modulus [GPa] | Density [$g/cm^3$] | Linear Thermal Expansion [ppm/K] | Thermal Conductivity [W/m · K] | Specific Heat Capacity [J/g · K] | Specific Tensile Strength [N · m/g] | Weight Savings [%] |
|---|---|---|---|---|---|---|---|---|
| Steel 4140 Tempered | 655 | 205 | 7.85 | 12.2 | 33.5 | 0.452 | 83.4 | 56.8 |
| Steel 4140 Hardened | 1185 | 205 | 7.85 | 12.2 | 42.6 | 0.452 | 151 | 21.7 |
| SupremeEX AMC640XA | 560 | 140 | 2.9 | 13.4 | 130 | 0.800 | 193 | — |

TABLE 2

Comparison of different barrel types. The composite barrel characteristics are calculated on the basis of the metal-matrix material SupremeEX AMC640XA (see Table 1). Significant weight savings are possible, especially in comparison to heavy barrel profiles which are preferred due to their higher stiffness and accuracy. Furthermore, heat capacity and weight of the composite barrels can be adapted in a wide range depending on the intended barrel properties.

| | 4140 Steel Barrel Diameter | | Barrel Core Diameter | | Barrel Jacket Diameter | | Stiffness | Heat Capacity | Weight |
|---|---|---|---|---|---|---|---|---|---|
| | [in] | [mm] | [in] | [mm] | [in] | [mm] | [N − $m^2$] | [J/K − cm] | [g/cm] |
| AR-15 normal | 0.625 | 15.9 | | | | | $2.52 \times 10^3$ | 6.2 | 13.6 |
| AR-15 heavy | 0.75 | 19.1 | | | | | $5.26 \times 10^3$ | 9.3 | 20.5 |
| AR-15 composite barrel - minimal weight | | | .384 | 9.76 | .7 | 17.6 | $2.73 \times 10^3$ | 5.7 | 8.9 |
| AR-15 composite barrel - maximum stiffness | | | .384 | 9.76 | 1 | 25.4 | $1.21 \times 10^4$ | 12.9 | 16.8 |

It is noted that unless an embodiment is expressly stated as being incompatible with other embodiments, the concepts and features described with respect to each embodiment may be applicable to and applied in connection with concepts and features described in the other embodiments without departing from the scope of this disclosure. To that end, the above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

The invention claimed is:

1. A rifle barrel having a barrel core and at least one barrel jacket made from a metal-matrix material encasing the barrel core, thereby forming a metal-metal-matrix composite barrel, wherein the metal-matrix material comprises a silicon-carbide reinforced aluminum alloy having isotropic tensile strength and heat transfer properties, the silicon-carbide reinforced aluminum alloy comprising ultrafine silicon-carbide particles, wherein the metal-matrix material has a thermal expansion coefficient of between 10 ppm/K and 15 ppm/K, and wherein the thermal expansion coefficient of the barrel core is within 20% of the thermal expansion coefficient of the barrel jacket.

2. The rifle barrel of claim 1, wherein the metal matrix material has a specific tensile strength that is greater than or equal to 80 N·m/g and greater than or equal to the specific tensile strength of the barrel's core material.

3. The rifle barrel of claim 1, wherein the metal matrix material comprises a material having a linear thermal expansion coefficient between 0 and 30 ppm/K.

4. The rifle barrel of claim 1, wherein the metal matrix material comprises a material having a thermal conductivity between 5 to 400 W/m·K.

5. The rifle barrel of claim 1, wherein the metal matrix material comprises a material having a specific heat capacity greater than 0.45 J/g·K.

6. The rifle barrel of claim 1, wherein the at least one barrel jacket extends over at least 30% of the rifle barrel.

7. The rifle barrel of claim 1, wherein at least one barrel jacket is adhered to the barrel core by an interference fit.

8. The rifle barrel of claim 1, wherein the rifle barrel comprises a fluted surface.

9. The rifle barrel of claim 1, wherein the rifle barrel comprises a variable diameter.

10. The rifle barrel of claim 1 comprising a portion of a weapon, the weapon being selected from the group consisting of a semi-automatic weapon and an automatic weapon.

11. The rifle barrel of claim 1, wherein the filler is a particulate material.

12. The rifle barrel of claim 1, wherein the barrel core is composed a material selected from the group consisting of 316 steel, 4140 steel, and 4150 steel.

13. The rifle barrel of claim 1, wherein the metal-matrix material comprises forty percent by volume ultrafine silicon-carbide particles.

14. A rifle barrel comprising: a barrel core comprising iron alloy; and at least one barrel jacket made from a metal-matrix material encasing the barrel core, thereby forming a metal-metal-matrix composite barrel, wherein the metal matrix material comprises an aluminum-silicon carbide composite wherein the metal-matrix material has a thermal expansion coefficient of between 10 ppm/K and 15 ppm/K and isotropic tensile strength and heat transfer properties, and wherein the aluminum-silicon carbide composite comprises ultrafine silicon-carbide particles, and wherein the thermal expansion coefficient of the barrel core is within 20% of the thermal expansion coefficient of the barrel jacket.

15. The rifle barrel of claim 14, wherein the at least one barrel jacket comprises a first, outer barrel jacket and second, inner barrel jacket disposed between the barrel core and the first, outer barrel jacket, and wherein the thermal expansion coefficient of the second, inner barrel jacket is greater than the thermal expansion coefficient of the second, inner barrel jacket.

16. The rifle barrel of claim 14, wherein the ratio of the barrel jacket diameter to the barrel core diameter is between 1.8 and 2.6.

17. The rifle barrel of claim 14, wherein the metal-matrix material comprises forty percent by volume ultrafine silicon-carbide particles.

18. The rifle barrel of claim 14, wherein the metal-matrix material can be joined to the core by as an isotropic powder by a process selected from the group consisting of: hot isotactic pressing, pressure fitting of semi-finished products, thermal shrinking, metal spinning, flow forming, forging and explosive welding.

19. A rifle barrel having:

a barrel core, a first, outer barrel jacket, and a second, inner barrel jacket disposed between the barrel core and the first, wherein the outer barrel jacket is made from a metal-matrix material, wherein the metal-matrix material comprises a silicon-carbide reinforced aluminum alloy having isotropic tensile strength and heat transfer properties, the silicon-carbide reinforced aluminum alloy comprising ultrafine silicon-carbide particles, wherein the metal-matrix material has a thermal expansion coefficient of between 10 ppm/K and 15 ppm/K, and wherein the thermal expansion coefficient of the barrel core is within 20% of the thermal expansion coefficient of the barrel jacket, wherein the thermal expansion coefficient of the second, inner barrel jacket is greater than the thermal expansion coefficient of the second, inner barrel jacket, and wherein the external surface of the first, outer barrel jacket comprises a fluted surface.

* * * * *